United States Patent [19]

Guy

[11] Patent Number: 4,605,457

[45] Date of Patent: Aug. 12, 1986

[54] TAPE TENSION CONTROL SYSTEM

[75] Inventor: Robert R. Guy, North Royalton, Ohio

[73] Assignee: Lof Plastics Inc., Troy, Mich.

[21] Appl. No.: 608,250

[22] Filed: May 8, 1984

[51] Int. Cl.[4] ..... B32B 31/00; B65H 23/10; B65H 59/14; B65H 59/18

[52] U.S. Cl. ..... 156/160; 156/229; 156/494; 264/288.4; 264/291; 242/75.2; 242/154; 242/156.1

[58] Field of Search ..... 156/84, 85, 160, 163, 156/164, 184, 229, 494, 495; 428/31, 77; 242/75.2, 147 R, 151, 154, 156, 156.1; 296/41, 93; 264/288.4, 339, 342 RE, 291; 26/18.6, 69 A; 293/128

[56] References Cited

U.S. PATENT DOCUMENTS

| | | | |
|---|---|---|---|
| 2,970,787 | 2/1961 | Libby | 242/75.2 |
| 3,331,568 | 7/1967 | Okamura | 242/154 |
| 3,439,950 | 4/1969 | Kunevicius | 428/31 X |
| 3,531,348 | 9/1970 | Kunevicius | 156/164 |
| 3,669,794 | 6/1972 | Mazur | 156/494 |
| 4,172,745 | 10/1979 | Van Manen | 156/160 |
| 4,365,767 | 12/1982 | Benthimere | 242/75.2 |

FOREIGN PATENT DOCUMENTS

| | | | |
|---|---|---|---|
| 1013239 | 7/1952 | France | 242/75.2 |

*Primary Examiner*—Edward Kimlin
*Assistant Examiner*—Ramon R. Hoch
*Attorney, Agent, or Firm*—Phillip S. Oberlin

[57] ABSTRACT

A method and system for tensioning and applying a foam core tape having pressure sensitive adhesive faces to a body side molding. The method is effected to obtain the necessary stretch in the foam core tape to coordinate with any dimensional changes which may occur in the body side moldings to which it is bonded. The system includes a tensioning roll disposed between a supply roll and the point of application of the tape to the body side molding. The peripheral surface of the tensioning roll frictionally engages the foam tape and the rotation of the tensioning roll is controlled by suitable braking mechanism to effect a desired stretch in the tape prior to its application to the body molding.

3 Claims, 2 Drawing Figures

TAPE TENSION CONTROL SYSTEM

BACKGROUND OF THE INVENTION

This invention relates to tension control systems and more particularly to a system and method for applying a double-faced, pressure sensitive adhesive foam core tape to a trim strip.

Currently, automotive body side moldings and trim strips are manufactured from plastic material and secured to the side of automobile bodies by double-faced, pressure sensitive adhesive foam core tape. The plastic moldings are subject to some amount of stretching and stressing during processing. For example, some shrinkage of the plastic molding occurs as it cools down, and additional shrinkage occurs with aging of the molding as stresses induced therein tend to relieve themselves. Thus, when foam core tape is first applied to the hot body side molding it must be tensioned to provide a coordinated stretch with the stretch in the side molding so as to shrink and/or stretch therewith. If too great a length of foam tape is applied to a body side molding it tends to wrinkle and/or buckle thus compromising the adherence of the side molding to an automobile body.

Heretofore, double-faced pressure sensitive adhesive foam core tape was applied to a substrate such as a body side molding by employing a predetermined weight riding against the tape to create a drag thereon so as to stretch the tape at a given rate as it is being applied to the substrate. Another method of applying a pressure sensitive adhesive foam core tape to a substrate was to arch the substrate to place it in a compressed state, apply the tape to the arched substrate, and release the substrate from its arched condition to tension and stretch the foam core tape.

However, the above methods were not entirely satisfactory in that the shrinkage of the body side molding is not totally predictable making it difficult to determine the force needed to obtain the desired stretch of the tape in the first described method or the amount of arching of the body side molding in the later described method. Also, these prior methods needed tool changes for each degree of stretch required. In some cases, the necessary tooling changes required a complete shutting down of the associated production lines.

SUMMARY OF THE INVENTION

Briefly, the system and method of applying double-faced, pressure sensitive adhesive foam core tape to a body side molding or other trim strip according to the present invention provides for infinite changes to the stretching of the tape to eliminate excess tape on the molding once the molding shrinks as previously described.

The system includes a supply roll for supplying a double-faced adhesive foam core tape to a release roll where the tape temporarily adheres to the release roll, the rotation of which is controlled by a variable braking mechanism for infinitely varying the amount of stretching of the foam tape as it is being applied to a substrate such as an automotive body side molding.

The method of tensioning a double-faced adhesive foam core tape and applying it to a substrate comprises the steps of applying an adhesive face of the tape to the underface of a substrate, guiding the adhesive face of the tape over a peripheral portion of a roll where the adhesive face temporarily adheres to the periphery of the roll, and braking the rotation of the roll to induce a stretching of the tape to coordinate with the stretch in the substrate.

An object of the invention is to stretch a double-faced, pressure sensitive adhesive foam core tape upon application to a molding or trim strip which shrinks for eliminating excess tape on the piece once it shrinks.

BRIEF DESCRIPTION OF THE DRAWINGS

The above mentioned and other features, objects and advantages and manner of obtaining them are described more specifically below by reference to an embodiment of the invention shown in the accompanying drawings, in which.

DESCRIPTION OF THE PREFERRED EMBODIMENT

Figure 1:
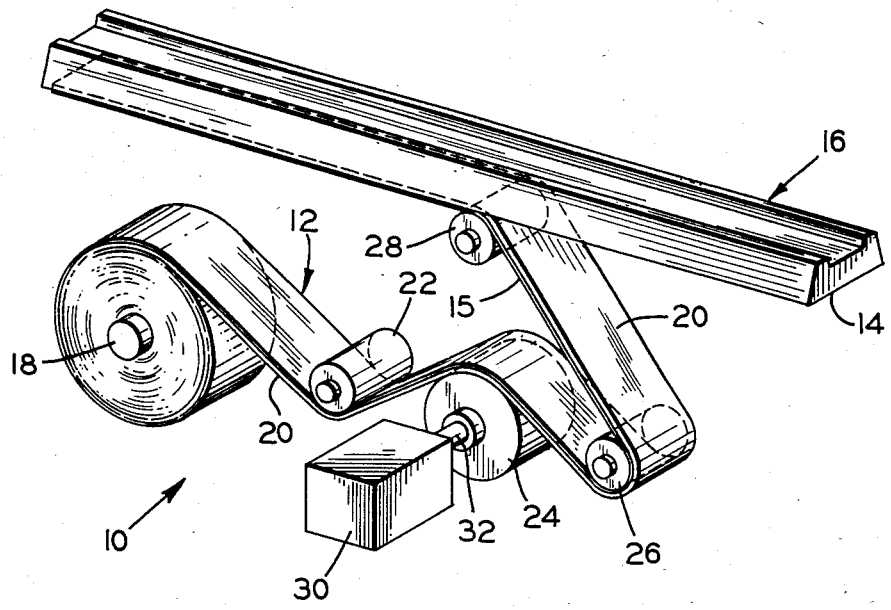
FIG. 1 is a diagrammatic perspective view illustrating the system of the present invention.
Figure 2:
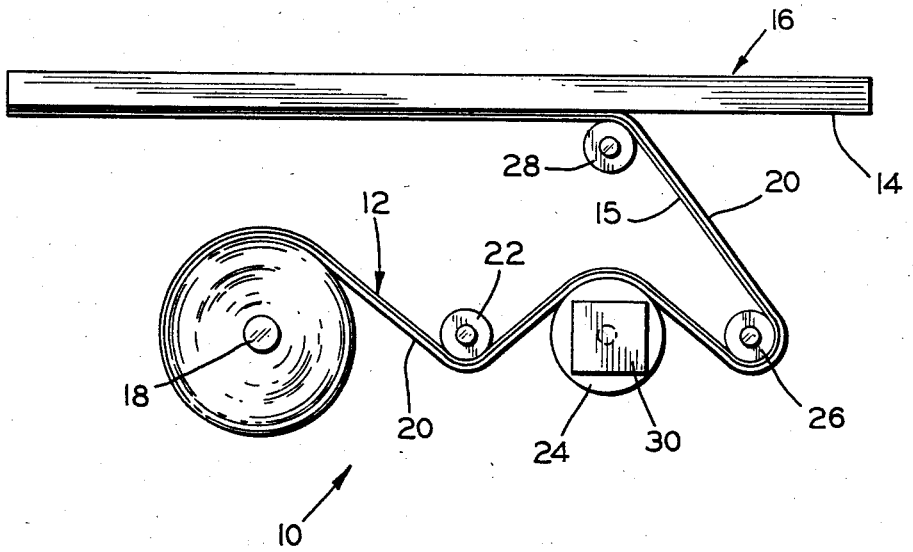
FIG. 2 is a diagrammatic elevational view of the system illustrated in FIG. 1.

Referring now to FIGS. 1 and 2, there is illustrated a system 10 for applying a double-faced, pressure sensitive adhesive foam core tape 12 to the undersurface 14 of a body side molding 16. The system 10 includes a supply roll 18 for supplying one adhesive face 20 of the tape 12 by guide roll 22 to release roll 24, the purpose of which will be described hereinafter. The supply roll 18 carries a wound supply of foam core tape 12 for common rotation about its longitudinal axis. From the release roll 24, the foam tape 12 is entrained about a guide roll 26 and a guide roll 28 positioned adjacent the underface 14 of the body side molding 16 and which functions to press the adhesive face 20 of the foam core tape 12 thereagainst.

In the above connection, the foam core tape is provided with a liner or backing 15 which protects both adhesive surfaces when the tape is wound on the supply roll and the adhesive surface opposite the surface 20 after application of the tape to the molding. This backing strip or liner 15 is, of course, removed from the molding 16 to expose the adhesive when the molding is to be mounted or attached to a vehicle.

As best illustrated in FIG. 2, the foam tape 12 is entrained to travel under the periphery of guide rolls 22 and 26 and over the periphery of the release roll 24 with the adhesive face 20 of the tape 12 bearing against the peripheral surface of the release roll 24. The adhesive face 20 of the tape 12 will temporarily adhere to the surface of the release roll 24.

An infinitely variable brake 30, such as a conventional electronic brake, is coupled to a shaft 32 extending from the release roll 24 for retarding the rotation of the release roll 24.

It should be noted that the adhesive face 20 of the foam tape 12 will temporarily adhere to a smooth "non-stick" surface of the release roll 24. This temporary adherence of the foam tape 12 to the release roll 24 causes the foam core tape 12 to stretch between the undersurface 14 of the body side molding 16 and the release roll 24. The temporary "stick" of the foam core tape 12 to the release roll 24 allows the brake 30 to be adjusted to produce a desired amount of stretch. Accordingly, the amount of stretch of the tape is determined by the brake 30.

After a stretched foam core tape 12 is bonded to the side molding 16, the resulting assembly can be tested by immersing same in a 145° F. water bath for five minutes.

If no ripples or puckering develop in the tape liner the stretch of the foam tape is proper. However, if ripples develop in the tape liner, the foam tape 12 should be stretched to a greater degree by retarding the rotation of the release roll 24.

It is to be understood that the form of the invention herewith shown and described is to be taken as a preferred embodiment only of the same and that various changes in the shape, size, and arrangement of the parts may be resorted to without departing from the spirit of the invention.

I claim:

1. In a method of precisely tensioning a pressure sensitive adhesive tape and applying it to a substrate, the steps comprising:

(a) guiding the pressure sensitive adhesive face of a portion of the tape over a smooth peripheral surface of a rotating roll wherein the adhesive face of the tape temporarily sticks to the smooth peripheral surface of the roll and wherein the portion of the tape being guided over the rotating roll is only contacted on the adhesive face such that the opposite face thereof is exposed and uncontacted;

(b) applying the adhesive face of the tape to the face of a substrate; and (c) variably braking the rotation of the rotary roll to induce a stretch in the tape extending between the substrate and the rotating roll to coordinate with any stretch in the substrate whereby the tape and substrate stretch and shrink in unison.

2. The invention defined in claim 1, including the step of entraining a non-adhesive face of the pressure sensitive adhesive tape over guide rolls with its adhesive face in contact with the a smooth surface of the rotary roll.

3. The invention defined in claim 2, including the step of entraining the pressure sensitive adhesive tape over a guide roll positioned adjacent to the surface of the substrate and pressing the adhesive face of the tape to the substrate.

* * * * *